US005462378A

United States Patent [19]

Webb

[11] Patent Number: 5,462,378

[45] Date of Patent: Oct. 31, 1995

[54] SOAPSOCK

[76] Inventor: William A. Webb, Avent Ferry Rd. P.O., Raleigh, N.C. 27606

[21] Appl. No.: 199,423

[22] Filed: Mar. 30, 1994

[51] Int. Cl.[6] ..... A47K 5/05; A47K 7/03

[52] U.S. Cl. ..... 401/201

[58] Field of Search ..... 401/201

[56] References Cited

U.S. PATENT DOCUMENTS

| | | | |
|---|---|---|---|
| 1,292,982 | 1/1919 | Wolf | 401/201 X |
| 2,697,847 | 12/1954 | Levinson et al. | 401/201 X |
| 2,817,865 | 12/1957 | Arioli | 401/201 |
| 4,228,834 | 10/1980 | Desnik | 401/201 X |
| 4,480,939 | 11/1984 | Upton | 401/201 |
| 5,022,517 | 6/1991 | Benitez | 401/201 X |

FOREIGN PATENT DOCUMENTS

| | | | |
|---|---|---|---|
| 164586 | 11/1949 | Austria | 401/202 |

*Primary Examiner*—Steven A. Bratlie
*Attorney, Agent, or Firm*—John G. Mills and Associates

[57] ABSTRACT

This invention is a washcloth adapted for retaining a bar of soap for use in the bath or shower. The washcloth is fabricated from a continuous, tubular elastic cloth cut into predetermined lengths and stitched together at a closed end forming an internal pocket in a manner similar to that of a conventional sock. An open end of the internal pocket includes an elastic band stitched about the perimeter of the open end which contracts to retain the bar of soap after it has been inserted into the washcloth. Embedded in the elastic band at regular intervals are a plurality of retaining ridges which are disposed inwardly and elastomerically biased to contact the end surface of the bar of soap thereby retaining it within the washcloth. A pair of pull rings are attached to the elastic band and function as finger holds for leverage when inserting the bar of soap into the washcloth. The washcloth contracts to conform to the bar of soap as it is dispensed and used up thereby reducing soap wastage.

6 Claims, 1 Drawing Sheet

SOAPSOCK

FIELD OF INVENTION

This invention relates to a holder for bar soap, and, more particularly to a portable soap holder for retaining and dispensing bar soap for use in the bath or shower.

BACKGROUND OF INVENTION

Normally, bar soap is placed in an existing soap dish or tray after it is used. Typically, a nearby rack is used to hold the wash cloth. Although this arrangement is simple and inexpensive, it has many disadvantages. Water in the bottom of the soap dish accumulates and the bar of soap eventually is softened by its contact with the water in the dish. The next time the soap is used, the soft outer portion of the bar of soap quickly washes away, resulting in considerable product loss. Not only is such softening wasteful of soap, but it renders a bar less attractive in appearance and gives it an unpleasant texture and feel.

Another problem with bar soap results from its slippery surface when wet which makes the bar hard to hold onto. As a result wet soap is often dropped, which is annoying, especially when this occurs in a shower stall. Sometimes the bar, when dropped, will split into two or more pieces, which obviously results in more soap wastage.

Recent attempts have been made to provide soap bags for use both as washcloths and as portable soap receptacles. However, none of the presently available soap bags has provided an inexpensive and easily used combination washcloth and soap receptacle, primarily because of the difficulty achieving simplicity of construction, and also because of the use of inadequate mesh fabric.

CONCISE EXPLANATION OF PRIOR ART

U.S. Pat. No. 4,228,834 to Shirley Desnick discloses a soap bag comprised of plastic mesh fabric having Velcro fasteners to permit temporary closing of the bag.

U.S. Pat. No. 2,697,847 to Isaac Levinson, et al. discloses a soap sponge and holder having a pocket for retaining a bar of soap and a closure having finger receiving rings to retain the sponge.

U.S. Pat. No. 2,817,865 to Fortunata Arioli discloses a sponge covered washcloth with soap pocket to receive a cake of soap.

U.S. Pat. No. 4,480,939 to Garthop Upton discloses a soap holding and dispensing means including a pouch formed from synthetic netting material sized to received a bar of soap.

U.S. Pat. No. 5,022,517 to Abel G. Benitez discloses a bar soap wrap for retaining and protecting bar soap during washing operations.

U.S. Pat. No. 1,292,982 to Melanie Wolf discloses a soap cover and soap applying device including a pocket for retaining and dispensing soap.

Finally, Austrian Patent No. 164586 to Josef Theiszenberger discloses a soap holder comprised of an elastic mesh material having an elastic opening for insertion of a bar of soap therein.

BRIEF DESCRIPTION OF INVENTION

After much research and study into the above mentioned problems, the present invention has been developed to provide a portable washcloth and soap holder for retaining a bar of soap for use in the bath or shower. The soap holder of the present invention is made from porous, elastic cloth woven with a terrycloth material suitable for use as a wash cloth.

The soap holder is generally tubular in shape and is expandable to a size slightly larger than the size of a regular bar of bath soap.

An open end of the soap holder has an elastic band sewn into it which contracts to retain the bar of soap after it is inserted into the soap holder. Embedded in the elastic band at regular intervals are retaining ridges which are disposed inwardly at the open end of the soap holder in order to retain the bar of soap after insertion of the same into the soap holder and expansion to functional size.

A pair of pull rings are attached to the elastic band and serve as finger holds for leverage when inserting a bar of soap into the soap holder.

In view of the above, it is an object of the present invention to provide a combination washcloth and bar soap holder which is both inexpensively fabricated and easy to use.

Another object of the present invention is to provide a soap holder in which means is provided for retaining the soap until it is completely used thereby preventing wastage.

Another object of the present invention is to provide a combination soap holder and washcloth with a texture and feel which will make the product desirable for use in the bath or shower.

Another object of the present invention is to provide a washcloth and soap holder which is fabricated of a material which makes the bar of soap easy to hold onto when wet.

Other objects and advantages of the present invention will become apparent and obvious from a study of the following description and the accompanying drawings which are merely illustrative of such invention.

DETAILED DESCRIPTION OF INVENTION

Figure 1:
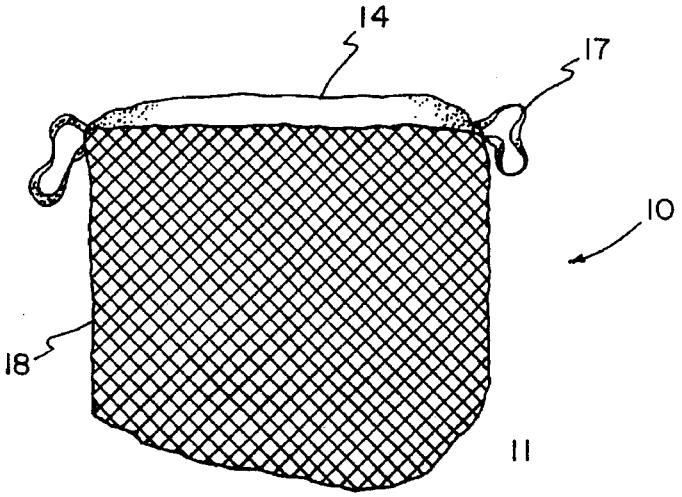
FIG. 1 is a front elevational view of the soap holder of this invention.

With further reference to the drawings, a soap holder in accordance with the present invention is illustrated in FIG. 1 and indicated generally at 10. In the embodiment shown, soap holder 10 is made from a piece of porous, elastic cloth woven with a terry cloth material suitable for use in the bath or shower.

Soap holder 10 is fabricated in a manner similar to that of a conventional sock from a continuous, tubular elastic cloth cut into predetermined lengths and stitched together at a closed end 11 forming an expandable body 18 having an internal pocket 12. Soap holder 10 is of a generally tubular shape in both contracted and expanded configurations as illustrated in FIGS. 1 and 2.

Figure 2:
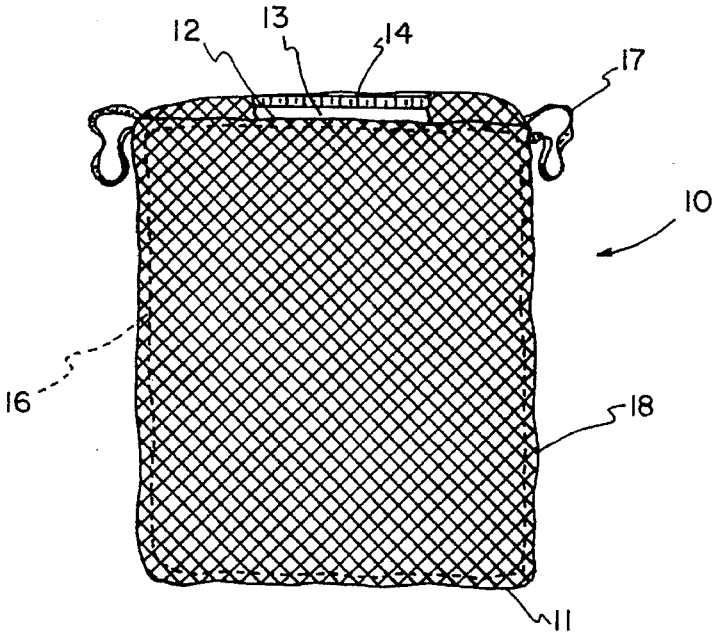
FIG. 2 is a front elevational view of the soap holder of this invention expanded to its functional size.

A mouth 13 of soap holder 10 includes an elastic band 14, stitched about the perimeter of mouth 13 as shown in FIG. 2. Elastic band 14 has a diameter which is smaller than the inside diameter of expandable body 18 when both are in a contracted condition. Thus, mouth 13 of soap holder 10 will remain smaller than the end of a bar of soap 16 thereby retaining the same in soap holder 10, even after body 18 is fully expanded.

Figure 3:
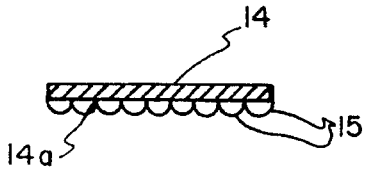
FIG. 3 is an enlarged fragmentary view of the elastic band with retaining ridges used in the soap holder of this invention.

Embedded in elastic band 14 at regular intervals are a plurality of retaining ridges 15 which are positioned on an inner surface 14*a* of elastic band 14 as shown in FIG. 3. Retaining ridges 15 are disposed inwardly and are elastomerically biased to contact an end surface of bar of soap 16. This ensures that soap 16 will not be forced out of soap holder 10 due to the increased tension created by expansion of body 18 particularly when wet.

A pair of pull rings 17 are attached to elastic band 14 and function as finger holds for leverage when inserting the bar of soap 16 into soap holder 10.

It will be appreciated that expandable body 18 will contract about the surface of bar of soap 16 and remain as it is dispensed and used up thereby reducing soap wastage.

From the above it can be seen that the present invention has the advantage of providing a relatively simple, portable and inexpensively fabricated washcloth adapted to retain a bar of soap, which will make the product desirable for use in the bath or shower. The present invention is fabricated from a material which makes a bar of soap easy to hold onto when wet and which will contract around the surface of the soap as it is dispensed thereby retaining even a small piece of soap and reducing wastage.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

I claim:

1. A wash cloth adapted to receive a bar of soap, comprising:

a generally tubular shaped body of porous, elastic cloth stitched closed at one end, to form a longitudinal pocket therein, said pocket being open at the opposite end to form a mouth;

an elastic band disposed about the periphery of the mouth of said pocket, and being stitched to form a diameter smaller than the diameter of the tubular body when in contracted condition; and a plurality of inwardly projecting retaining ridges mounted at regular intervals on the inner surface of said elastic band whereby said ridges are elastomerically biased against one end of a bar of soap after it is inserted in the longitudinal pocket.

2. The washcloth of claim 1 wherein the body of washcloth contracts about the bar of soap as the soap is dispensed.

3. The washcloth of claim 2 wherein a pair of pull rings are attached to the elastic band, to provide a finger hold for leverage whereby a bar of soap may be inserted into said pocket of said washcloth.

4. The washcloth of claim 3 wherein the retaining ridges are fabricated from a plastic material.

5. The washcloth of claim 4 wherein the retaining ridges are generally semi-circular in shape.

6. The washcloth of claim 5 wherein said elastic cloth consists of a terrycloth material.

* * * * *